United States Patent [19]

Carroll

[11] 3,939,914

[45] Feb. 24, 1976

[54] COMBINATION AIR CONDITIONING AND FIRE PROTECTION SYSTEM FOR A BUILDING

[76] Inventor: John L. Carroll, P.O. Box 42413, Portland, Oreg. 97242

[22] Filed: Apr. 26, 1974

[21] Appl. No.: 464,340

Related U.S. Application Data

[63] Continuation-in-part of Ser. No. 307,382, Nov. 17, 1972, abandoned.

[52] U.S. Cl. ..... 169/16; 169/20

[51] Int. Cl.[2] ..... A62C 35/00

[58] Field of Search ..... 169/5, 13, 20, 16, 17, 169/18; 165/138, 50; 239/125, 77

[56] References Cited

UNITED STATES PATENTS

| | | | |
|---|---|---|---|
| 1,087,136 | 2/1914 | Nutter et al. | 169/5 |
| 1,229,071 | 6/1917 | Hammond | 169/5 |
| 3,050,134 | 8/1962 | Multin | 169/5 |
| 3,212,555 | 10/1965 | Schuss et al. | 239/125 |
| 3,464,172 | 9/1969 | McGee, Jr. | 169/16 X |

*Primary Examiner*—John J. Love
*Attorney, Agent, or Firm*—Kolisch, Hartwell, Dickinson & Stuart

[57] ABSTRACT

A combination air conditioning and fire protection system for a building including a heat exchanger through which fluid may pass under pressure, a fluid conditioning unit operable to bring fluid to a desired temperature for passing through the heat exchanger, and fluid supply and return conduits interconnecting the heat exchanger and fluid conditioning unit for circulating fluid therebetween. The supply and return conduits have discharge heads spaced therealong which are openable in case of fire to discharge fluid therefrom to extinguish a fire in the vicinity of the head. The conduits may include risers in the form of hollow, fluid-tight structural columns which also act to provide structural support for the building. Flow control devices and check valves in the system assure that pressure will be maintained in either the supply or return conduits to discharge fluid onto a fire if the other conduit is damaged and loses pressure.

6 Claims, 6 Drawing Figures

COMBINATION AIR CONDITIONING AND FIRE PROTECTION SYSTEM FOR A BUILDING

SUMMARY AND BACKGROUND OF INVENTION

This is a continuation of application Ser. No. 307,382, filed Nov. 17, 1972 now abandoned.

This invention relates to a combination air conditioning and fire protection system for a building, and more particularly to such a system in which conduits for supplying air conditioning fluid to and returning fluid from heat exchangers also act to supply fluid to discharge heads for fire protection.

Modern buildings generally are provided with air conditioning systems for heating and/or cooling the building. These generally require conduit systems for providing a circulating flow of temperature control fluid to heat exchangers within the building. It is desirable also to have some form of fire protection system in the building, such as a water sprinkler system which is actuated when a fire occurs. Due to the high cost of installing such fire protection systems, in the past, frequently they have not been installed.

A general object of the invention is to provide a novel combination air conditioning and fire protection system for a building which is simple to install, low in cost, and eliminates duplication of piping.

More specifically, an object is to provide a novel combination air conditioning and fire protection system for a building which includes a heat exchanger through which air-conditioning fluid may pass, a fluid conditioning unit spaced from the heat exchanger for bringing the fluid to a desired temperature, a conduit system for circulating such fluid between the heat exchanger and the fluid conditioning unit and fluid discharge means located along the conduit means operable to discharge fluid (which is a fire extinguishing fluid) in the case of fire. With this system the conduit system supplying fluid to and returning fluid from the heat exchanger serves also to provide fire protection in the building, which reduces the labor and material expenses over former systems.

Yet another object is to provide such a novel combination air conditioning and fire protection system which includes supply and return conduits for carrying fluid under pressure to and away from a heat exchanger, with fluid discharge means mounted on the conduits for discharging fluid in case of fire, and flow control and check valve means interposed between the supply and return conduits for maintaining a pressurized condition in one if there is a loss of pressure in the other.

Still more specifically, an object is to provide such a novel system wherein the heat exchanger and fluid conditioning units are spaced vertically from each other and the conduit system supplying the heat exchanger and fluid discharge units includes risers. In an embodiment of the invention, the risers may be hollow, fluid-tight structural columns which serve also to provide structural support for the building. The ability of a fluid (such as water) flowing through the columns to absorb heat increases the fire resistance of the structural columns. The low temperature range of the fluid necessary to produce comfort air conditioning, the availability of the same fluid throughout the building to charge an automatic fire protection system, and the dependability of the fluid supply all operate to produce maximum protection and economy in the combined system.

DRAWINGS

These and other objects and advantages will become more fully apparent as the following description is read in conjunction with the drawings, wherein.

DETAILED DESCRIPTION OF AN EMBODIMENT TO THE INVENTION

Figure 1:
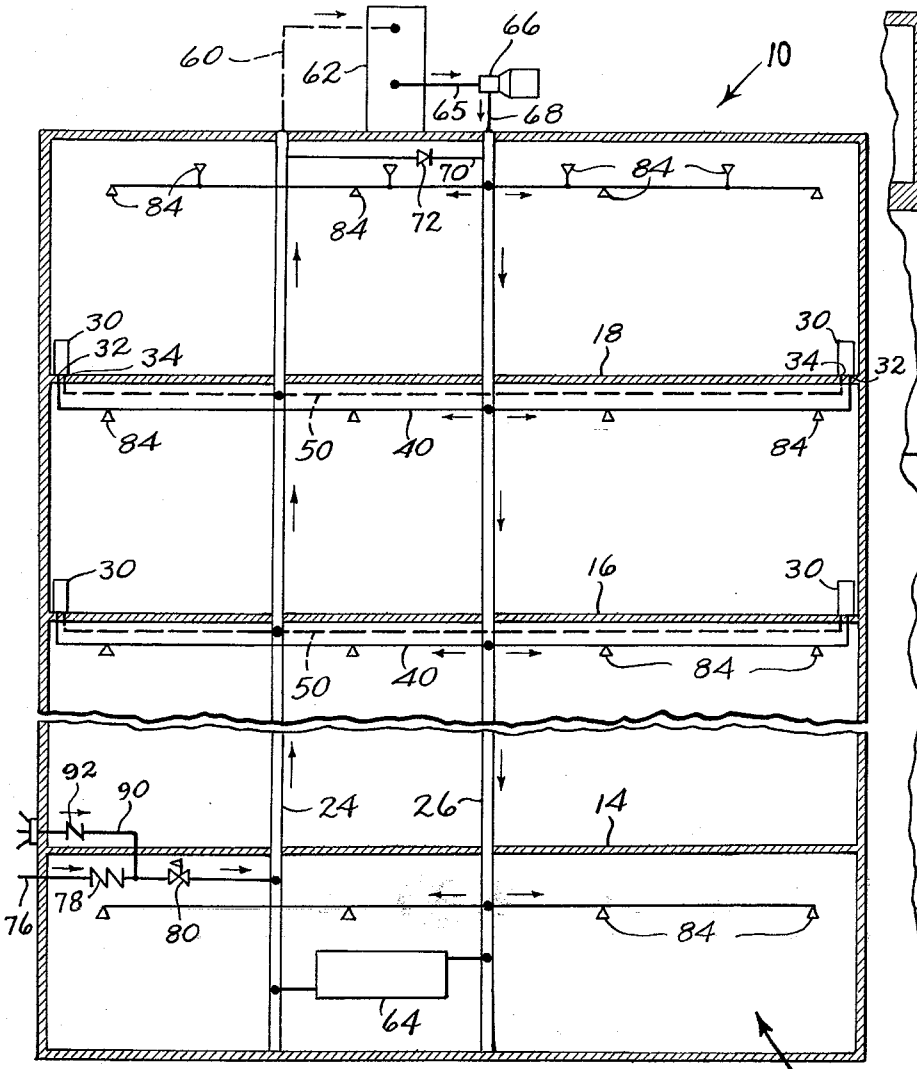
FIG. 1 is a schematic elevation view of a building incorporating the combination air conditioning and fire protection system of the invention.

Referring to the drawings, and first more specifically to FIG. 1, at 10 is indicated generally a multiple-story building having a basement 12 and floors 14, 16, and 18 at successively higher elevations in the building.

Figure 3:
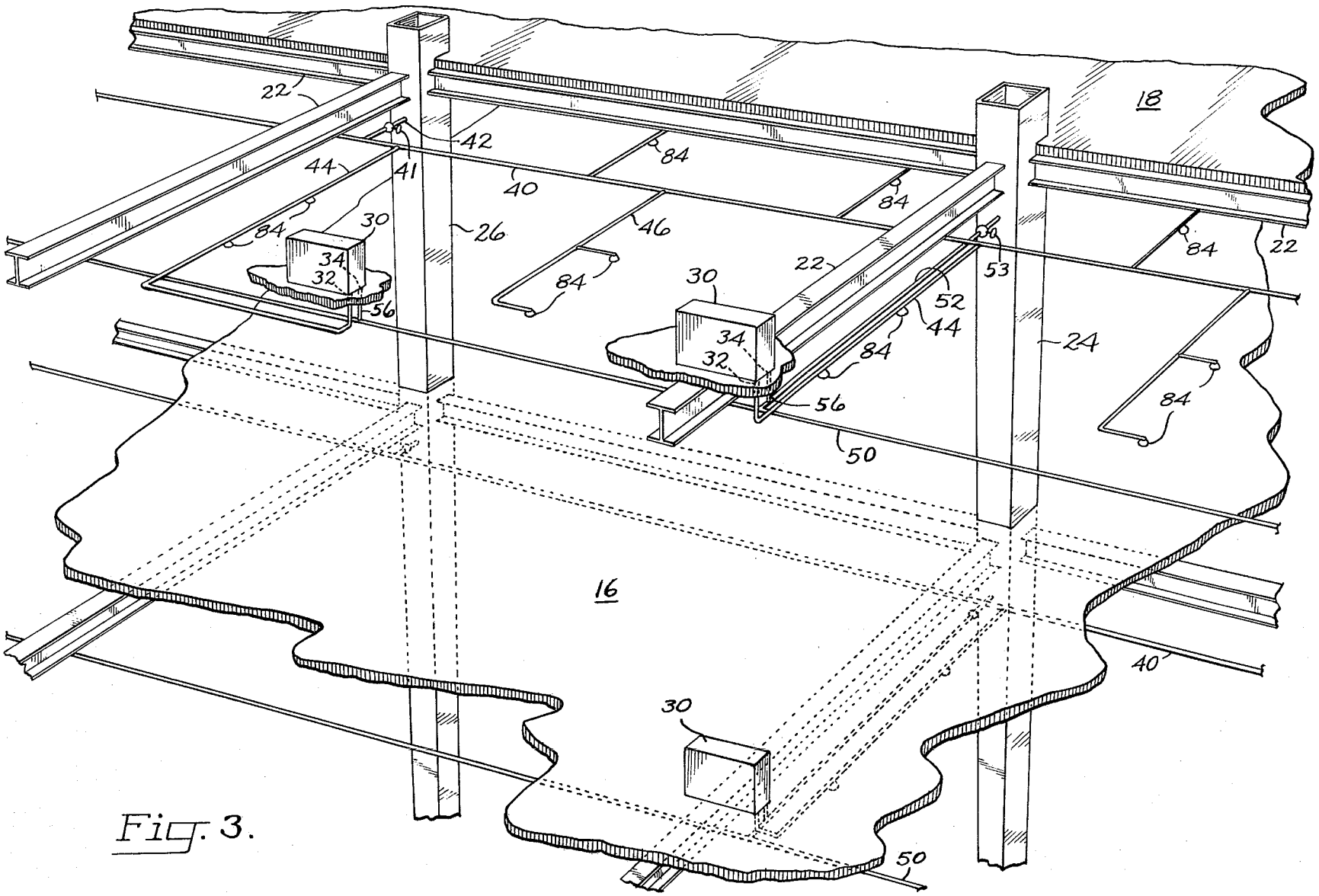
FIG. 3 is a perspective, cutaway view of a portion of a building incorporating such a system.

As is best illustrated in FIG. 3, each floor is supported on a set of substantially horizontal H-beams 22. Beams 22 are secured at their ends in a conventional manner to upright structural columns indicated at 24, 26. Each of the columns is a hollow, water and pressure tight, box-shaped section (as is seen where the two have been cut in FIG. 3) and extends fully the height of the building. As will be explained in greater detail below, the hollow interiors of columns 24, 26 define fluid passages extending vertically therethrough, whereby the columns are adapted to act as conduits, or risers, to carry fluid under pressure, such as water, either up or down through the building.

Mounted above the floor at each level of the building are a plurality of spaced-apart heat exchangers 30. Each heat exchanger has a fluid inlet indicated at 32 and a fluid outlet indicated at 34. A heat exchanger is adapted to have fluid at a preselected temperature and pressure passed therethrough either to heat or cool the portion of the building in the vicinity of the heat exchanger.

In the instant embodiment of the invention water is used as the fluid in the system. Other fluids also may be used if they are capable of being elevated or lowered to temperatures which may be required to provide comfort conditioning in the building and if they have fire extinguishing properties.

An elongate, substantially horizontal supply lateral pipe, or conduit, 40 is connected, through a stub pipe 42, with the interior of column 26. A shut-off valve 41 in conduit 42 permits selective closing off of that conduit, as will be explained below. Supply header conduits 44 extend substantially horizontally and laterally outwardly from supply lateral 40 and each connects to the fluid supply inlet 32 of a heat exchanger. Other horizontal conduits 46 also extend laterally outwardly from supply lateral 40 intermediate conduits 44.

An elongate, substantially horizontal fluid return lateral pipe, or conduit, 50 is connected, through an elongate horizontal conduit 52, with the interior of column 24, and is connected through conduits 56 with the fluid outlets 34 of the heat exchangers. A shut-off valve 53 in conduit 52 permits selective closing off of that conduit, as will be explained below.

All of the horizontal conduits are disposed at elevations adjacent support beams 22, and thus are a substantial distance above the underlying floor 16.

Referring now specifically to FIG. 1, column 24 is connected at its upper end, through a conduit 60, to the inlet side of a conventional fluid cooling tower 62 and its lower end is connected to the outlet side of a conventional fluid heater 64. The lower end of column 26 is connected to the inlet side of heater 64.

The outlet side of cooling tower 62 is connected through a conduit 65 to the inlet side of a motor-driven pump 66. The outlet side of the pump is connected through a conduit 68 to the upper end of column 26. A bypass conduit 70, connected at its opposite ends to the upper ends of columns 24, 26, respectively, provides a fluid flow path around pump 66 and cooling tower 62. A check valve 72 in conduit 70 permits fluid flow in one direction only, from column 24 to column 26.

A domestic water main, indicated generally at 76, is connected to column 24 through a check valve 78 and a flow alarm 80. This connection with the domestic water main provides means for replenishing any fluid lost from the system. The flow alarm, is operable to produce a signal if the flow from the water main to column 24 rises above a predetermined level and may be connected to an annunciator or other signaling means.

A plurality of normally closed sprayer, or sprinkler, fluid discharge heads 84 are connected to conduits 44, 46 at spaced-apart locations. These sprinkler heads may be of a conventional type which include means, such as fusible links, for sensing a fire in the vicinity of a head. Such sensing means is operable, on sensing a fire, to open the sprayer head to discharge fluid from the conduit to which it is attached to the region of the fire. As is seen in the figures, the sprayer heads are distributed at spaced intervals above their respective floors and thus are able to provide fire protection for wide areas of the building.

As mentioned previously the fluid supply and return conduits are disposed in horizontal planes adjacent beams 22. The conduits thus may be hidden by a suspended ceiling arrangement, with the sprinkler heads only being exposed.

Describing the operation of the apparatus thus far described the conduit system including columns 24, 26, conduits 40, 44, 46, 50, 52, and 60 are filled with water. Operation of pump 66 produces circulation of the water through the supply and return conduits, and thus through heat exchangers 30, heater 64, and cooling tower 62. Depending upon the desired temperature to be maintained within the building, the fluid can either be heated by heater 64 to a predetermined temperature as it is circulated in the system, or cooled to a predetermined temperature in cooling tower 62. Generally the fluid is maintained in a tepid range of approximately 75°–90°F.

With this system a substantially constant fluid pressure is maintained in the conduit system which is available to supply fluid to the heat exchangers 30 and to spray discharge heads 84.

Should a fire occur, the sprayer heads in the vicinity of the fire would be opened to discharge water onto the fire to extinguish it. As this occurs water from main 76 replenishes water to the system as it is discharged from the sprayer heads. Bypass conduit 70 and check valve 72 provide a path for the water to bypass pump 66 so that there is no pressure loss through the pump in the event of a power failure when the sprayer heads operate. As water is replenished from the main, the flow through flow alarm 80 increases to a point where a signal is given that a sprayer head has opened, thus acting as a fire alarm. Should it be necessary, to provide additional water, as in the event of a water pressure failure at the main, an auxiliary water supply may be connected to an inlet conduit 90 which connects, through a check valve 92, to column 24.

Optionally a fluid storage tank may be positioned at a high point in the system (i.e., on the roof of the building) to provide storage for both fire protection and/or air conditioning. Such tank would be incorporated as a part of the circulating fluid system with fluid flowing therethrough.

Figure 4:
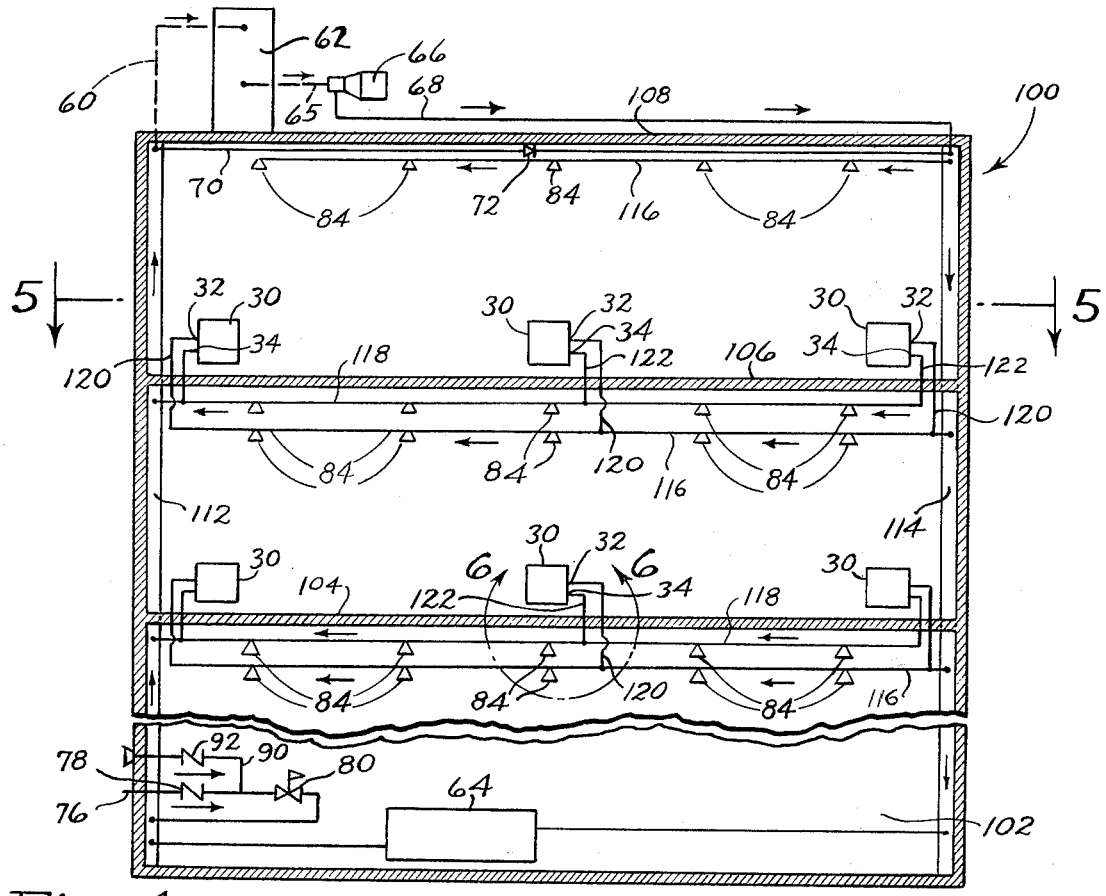
FIG. 4 is a schematic elevation view of a portion of a building incorporating a modified form of the invention.
Figure 5:
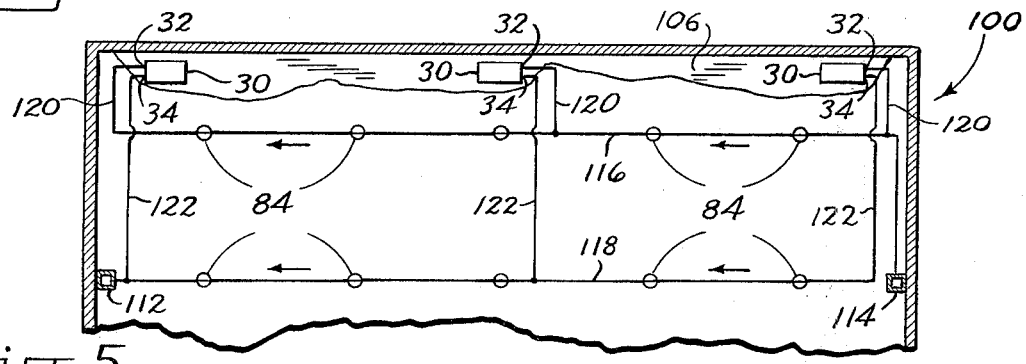
FIG. 5 is a plan view, taken generally along line 5—5 in FIG. 4, of a portion of a floor in the building incorporating the modified form of the invention.
Figure 6:
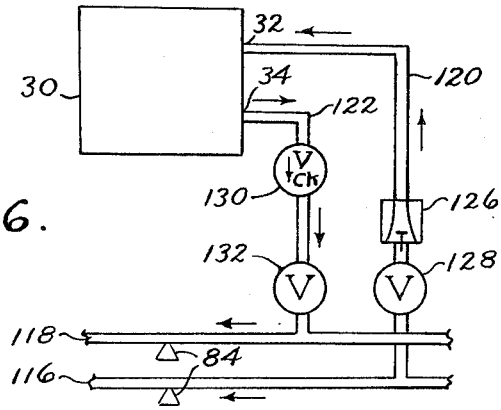
FIG. 6 is an enlarged view of a portion of the modified system indicated by line 6—6 in FIG. 4.

Referring to FIGS. 4, 5 and 6, a modified form of the combination air conditioning and fire protection system is illustrated in a building somewhat similar to the building illustrated in FIG. 1, and with substantially similar fluid temperature conditioning means and auxiliary fluid supply for the building. Explaining further, building 100 has a basement region 102, floors 104, 106 at successively higher elevations, and a roof 108. Upright, hollow, water and pressure tight boxshaped upright structural columns 112, 114 extend fully the height of the building to provide support for the building. Columns 112, 114 are constructed and have substantially the same function as previously described for columns 24, 26. Columns 112, 114, however, are positioned adjacent exterior walls of the building, as opposed to the interior mounting for columns 24, 26.

Mounted above the floor at each level of the building are a plurality of spaced-apart heat exchangers 30, as previously described each having a fluid inlet 32 and a fluid outlet 34. Each heat exchanger is adapted to have fluid at a preselected pressure and temperature passed therethrough either to heat or cool the portion of the building in the vicinity of the heat exchanger. Each heat exchanger acts as a flow limiting condenser in the system.

Elongate, substantially horizontal fluid supply lateral pipes, or conduits, 116 are connected at one set of their ends to the interior of column 114. Elongate, substantially horizontal fluid return lateral pipes, or conduits, 118 are connected at one set of their ends to the interior of column 112. As is best seen in FIG. 4, a pair of conduits 116, 118 extend adjacent and beneath each of floors 104, 106 and are spaced a distance above such underlying floors. Conduits 116, 118 associated with a floor are spaced apart laterally as seen in FIG. 5 to overlie different regions of the underlying floor, but are disposed at substantially a common elevation. Although each of conduits 116, 118 at a selected floor are disposed at substantially common elevations, they have been illustrated somewhat vertically spaced apart in FIG. 4 for illustrative purposes.

The fluid supply inlet 32 of each of heat exchangers 30 is operatively connected through a connecting conduit 120 to supply conduit 116. The fluid outlet 34 of each heat exchanger 30 is connected through a connecting conduit 122 to fluid return conduit 118.

Referring to FIG. 6, it will be seen that a constant flow valve 126 is connected in connecting conduit 120 intermediate supply conduit 116 and fluid inlet 32 of a heat exchanger. The flow control valve, or regulator, may be of conventional construction, as exemplified by the flow regulators designated as Dole regulators manufactured and sold by the Eaton Corporation. Such a flow control valve is operable to maintain a substantially constant volumetric flow of fluid therepast over a wide range of pressure variations.

A gate valve 128 is interposed in conduit 120 between supply conduit 116 and flow control valve 126.

Mounted in conduit 122 is a check valve 130 operable to permit flow of fluid freely from fluid outlet 34 of the heat exchanger toward return conduit 118, but inhibiting flow of fluid in a reverse direction. Connected in conduit 122 intermediate check valve 130 and conduit 118 is a gate valve 132.

A plurality of normally closed sprayer, or sprinkler, fluid discharge heads as previously described at 84 are connected to conduits 112, 114 at spaced-apart locations over the floor.

As previously described in relation to the building and system illustrated in FIG. 1, in a system as illustrated in FIGS. 4 and 5, column 112 is connected at its upper end through a conduit 60 to the inlet side of a fluid cooling tower 62 and at its lower end is connected to the outlet side of a fluid heater 64. The lower end of column 114 is connected to the inlet side of heater 64.

The outlet side of cooling tower 62 is connected through a conduit 65 to the inlet side of a motor driven pump 66. The outlet side of the pump is connected through a conduit 68 to the upper end of column 114. A bypass conduit 70 connected at its opposite ends to the upper ends of columns 112, 114, respectively, provides a fluid flow path around pump 66 and cooling tower 62. A check valve 72 in conduit 70 permits fluid flow in one direction only, from column 112 to column 114.

A domestic water main, indicated generally at 76, is connected to column 112 through a check valve 78 and a flow alarm 80. This connection with the domestic water main provides means for replenishing fluid lost from the system. An auxiliary water supply may be connected to an inlet conduit 90 which connects, through a check valve 92 to column 112 also.

Figure 2:
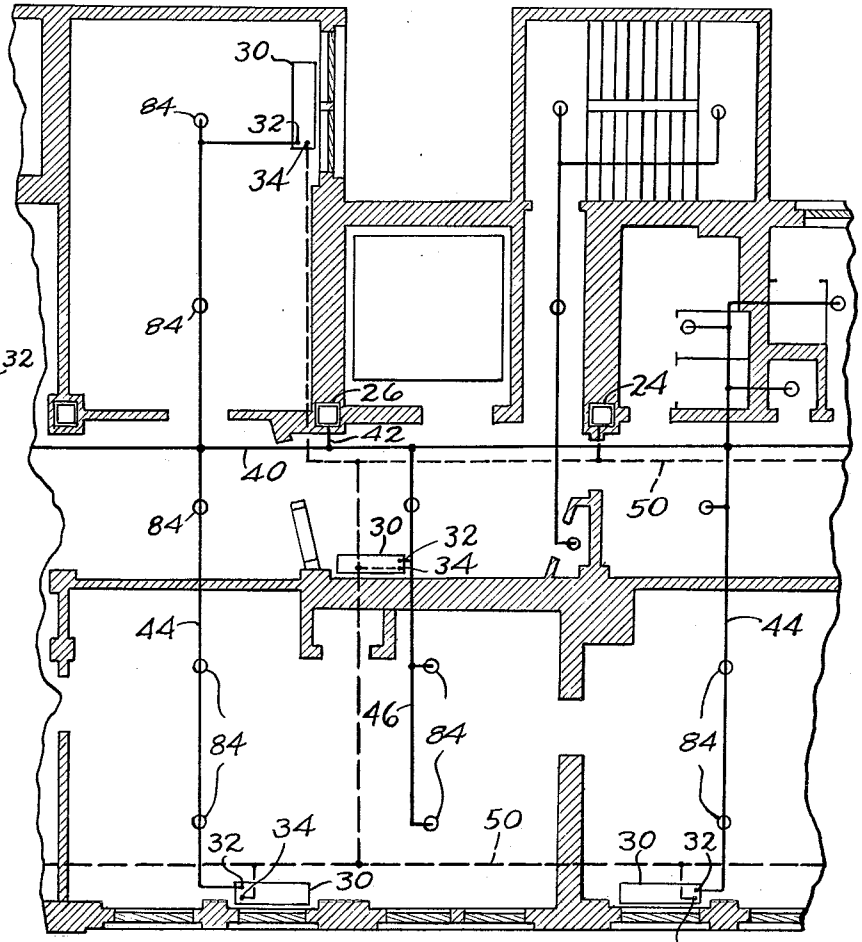
FIG. 2 is a schematic top plan view of a portion of a floor in such building.

Operation of the system illustrated in FIGS. 4, 5 and 6 is somewhat similar to that previously described for the system of FIGS. 1, 2 and 3. Columns 112, 114, conduits 116, 118, 120, 122, 60, 65, 68 and 70 are filled with water, or other fluid which can provide proper air conditioning and fire extinguishing functions. Operation of pump 66 circulates water through the supply and return conduits and thus through heat exchangers 30, heater 64 and cooling tower 62. The fluid will be heated or cooled as required and generally is maintained in a tepid range of approximately 75°–90°F.

As fluid circulates through the system from supply column 114 to return column 112 the primary path for such circulation is through heat exchangers 30 and heater 64. Fluid passing, under pressure, from conduits 116 through a heat exchanger 30 as illustrated in FIG. 6 to conduit 118 passes through constant flow regulating valve 126 which maintains a substantially constant flow rate of fluid through the heat exchanger. Check valve 130 assures that flow will be maintained in a direction from conduit 116 to 118 and inhibits flow in a reverse direction.

Should a fire occur, the spray heads in the vicinity of the fire would be opened to discharge fluid onto the fire to extinguish it. As previously described for the first embodiment of the system water from main 76 or an auxiliary supply would replenish water discharged from the system.

Since fluid discharge heads are mounted on both the supply and return conduits on opposite sides of the heat exchangers additional safety in the system is provided. Explaining further, should a supply conduit 116 be damaged to the extent that pressure in such line is lost, line pressure in the return conduits will be maintained by virtue of the operation of check valves 130. These check valves prevent fluid under pressure from flowing back through the heat exchanger to the fluid supply conduits and thus maintain pressure within the return conduits for spraying on the fire. Likewise, should damage occur to the return conduits whereby pressure would be lost in the same, constant flow control valves 126 maintain sufficient pressure in supply conduits 116 to assure that fluid will be sprayed from the discharge heads mounted on the supply conduits to provide fire protection.

Further, the inherent flow limiting characteristics of the heat exchangers themselves further will aid in maintaining pressure in the supply conduit should pressure be lost in the return conduit.

In either of the systems described precautions should be taken to minimize the effects of oxidation, which may occur with a fluid such as water flowing through the support columns, and to minimize galvanic/electrolytic action which may produce corrosion in the columns. Dielectric unions may be employed in the structural connections to minimize galvanic/electrolytic action and oxidation problems may be minimized by the injection of sodium hexameta phosphate into the water in the system.

The system thus is able to provide air conditioning and fire protection fluid throughout the building without the need for separate sets of conduits for each. Further, the system incorporates watertight columns, or beams, which function as fluid conduits and also provide structural support for the building. The fluid flowing through the building support columns also increases the fire resistance of the columns.

By providing for substantially constant circulation of fluid through the system a further advantage is realized. In prior fire protection systems fluid has been allowed to remain substantially stagnant and the fluid, due to oxidation and other factors within the system, discolors, often turning brown or black. On activation of the discharge heads the discolored fluid has stained equipment, walls, and furnishings, thus increasing the damage. With the instant system providing substantially constant circulation such stagnation and discoloration of the working fluid does not occur and on activation of the spray system clean fluid is sprayed from the discharge heads.

While a specific embodiment of the invention has been described herein, it should be apparent to those skilled in the art that variations and modifications are possible without departing from the spirit of the invention.

It is claimed and desired to secure by Letters Patent:

1. A combination air conditioning and fire protection system for a building comprising:

a heat exchanger through which fluid may be passed under pressure, said heat exchanger having a fluid inlet and a fluid outlet;

fluid temperature conditioning means spaced from said heat exchanger for bringing fluid to a preselected temperature, fluid supply conduit means operatively connected to said conditioning means for carrying fluid under pressure from said conditioning means toward said heat exchanger, fluid return conduit means operatively connected to said conditioning means through which fluid under pressure may be conveyed from the heat exchanger to the conditioning means, discharge means mounted on said fluid supply and return conduit means operable to discharge fluid therefrom within said building in case of fire, first connecting conduit means operatively connecting the supply conduit means to the inlet of the heat exchanger, second connecting conduit means operatively connecting the return conduit means to the outlet of the heat exchanger, check valve means in said connecting conduit means permitting flow of fluid therethrough in a direction from said supply conduit toward said return conduit and inhibiting fluid flow in the opposite direction, and flow control means operable continuously to control the rate of fluid flow from said supply conduit to said return conduit as it passes through said heat exchanger for maintaining sufficient pressure in said supply conduit means to produce proper fluid discharge from said discharge means on said supply conduit means in the event of loss of pressure in said return conduit means or connecting conduit means downstream from said flow control means.

2. The system of claim 1, wherein said discharge means comprises a plurality of spaced-apart, normally closed fluid discharge heads mounted on said supply and return conduit means and fire sensing means connected to said discharge heads operable to open a discharge head upon sensing a fire.

3. The system of claim 1, wherein said supply conduit means comprises a riser and an elongate, substantially horizontal conduit connected adjacent one of its ends thereto, said return conduit means comprises a riser and an elongate substantially horizontal conduit connected adjacent one of its ends thereto, said horizontal conduits extending over regions of said building to be protected by said system with said discharge means mounted thereon, and said first and second connecting conduits are connected to the horizontal conduits of said supply and return conduit means respectively, with the flow of fluid from said supply conduit means to said return conduit means being through said heat exchanger.

4. The system of claim 1, wherein said conditioning means and said heat exchanger are spaced apart vertically and at least one of said conduit means comprises a fluid-tight structural column constructed to provide structural support for the building and having a fluid passage extending vertically therethrough, and wherein said system further comprises means for circulating fluid under pressure through said conduit means including said column.

5. The system of claim 4, wherein at least one of said conduit means further comprises an elongate, substantially horizontal conduit connected to and extending between said column and said heat exchanger and said discharge means comprises a plurality of normally closed discharge heads spaced apart along said conduit.

6. The system of claim 5, which further comprises fire sensing means connected to said discharge heads operable to detect a fire in the vicinity of a discharge head and to open the same upon sensing a fire.

* * * * *